US005419658A

United States Patent [19]

DeWitt

[11] Patent Number: 5,419,658

[45] Date of Patent: May 30, 1995

[54] THIN-WALLED PIPE DRIVING METHOD FOR FORMING PILES

[75] Inventor: Wayne DeWitt, 10816 SE. Evergreen, Vancouver, Wash. 98664

[73] Assignee: Wayne DeWitt, Vancouver, Wash.

[21] Appl. No.: 132,539

[22] Filed: Oct. 5, 1993

[51] Int. Cl.[6] ..... E02D 7/00

[52] U.S. Cl. ..... 405/233; 405/249; 405/257

[58] Field of Search ..... 405/233, 249, 256, 257, 405/253, 232; 52/155, 156, 158, 165

[56] References Cited

U.S. PATENT DOCUMENTS

| | | | |
|---|---|---|---|
| 1,844,871 | 2/1932 | Schmedes | 405/253 X |
| 2,269,646 | 1/1942 | Burke | 52/156 X |
| 2,465,557 | 3/1949 | Thornley | 405/233 |
| 2,779,161 | 1/1957 | Pickman | 405/249 X |
| 3,482,409 | 12/1969 | Clements | 405/257 X |
| 3,779,025 | 12/1973 | Godley et al. | 405/249 |
| 3,932,999 | 1/1976 | Todd | 405/249 |

FOREIGN PATENT DOCUMENTS

| | | | |
|---|---|---|---|
| 89624 | 7/1981 | Japan | 405/253 |
| 151729 | 9/1982 | Japan | 405/249 |
| 690141 | 4/1953 | United Kingdom | 405/233 |

*Primary Examiner*—Randolph A. Reese
*Assistant Examiner*—John A. Ricci
*Attorney, Agent, or Firm*—Chernoff, Vilhauer, McClung & Stenzel

[57] ABSTRACT

A method for forming a pile by driving a thin-walled pipe is disclosed. A closed-end thin-walled pipe is driven partially into the earth until firm bearing is reached. The partially driven pipe is partially filled with a concrete and the concrete is hardened. A mandrel is inserted into the partially-driven pipe to contact the hardened concrete, and the pipe is driven downwardly further by driving with the mandrel against the concrete until driving is complete. The completely-driven pipe is then cut off and further filled with concrete to the cut-off level. Excess pipe which has been cut off is used to make up further piles.

6 Claims, 1 Drawing Sheet 10
12
14
16
18
20
22
24

THIN-WALLED PIPE DRIVING METHOD FOR FORMING PILES

BACKGROUND OF THE INVENTION

This invention relates to a method for forming a load-carrying pile, and in particular to a method for forming a pile by driving a thin-walled pipe.

A load carrying pile can be formed by driving a hollow pipe into the ground, filling the pipe with fluid concrete and allowing the concrete to cure. For this pile-forming method, a thin-walled pipe is less expensive to use than a pipe having a more substantial wall thickness. However, pipe used to form such a pile must have a wall thickness sufficient to withstand the force required to drive the pipe into the ground. Typical methods of driving pipe do not permit the use of thin-walled pipe because such pipe fails, or collapses, before it can be driven to a sufficient depth or refusal bearing.

U.S. Pat. No. 2,779,161 to Pickman discloses a method for constructing a pile by driving a pipe into the ground by means of a drop hammer rammer which strikes a concrete plug located at the lower, or driving, end of the pipe, after which the pipe is filled with concrete. Japanese Patent Publication No. 57-151729 discloses a similar method including filling the tip of a pipe with concrete, hardening the concrete, placing a buffer such as sand on the concrete and driving the pipe by using a drop hammer rammer to strike the buffered concrete. However, each of these methods is limited to use with a drop hammer and short sections of pipe, for example 40-foot sections, which is inherently slow. Use of a powered hammer (air-diesel, etc.) and mandrel for driving longer pipes would be faster, but is impractical in view of the excessively long mandrel required if longer pipes are used.

In addition, by using a bottom-driven short concrete plug, there is a chance of driving the plug out the bottom due to increased frictional resistance on the exterior of the pipe as the pipe drives deeper. Japanese Patent No. 57-151729 suggests the use of spiral pipe to resist expulsion of the plug by the raised bead (weld-padding) formed when the steel plate (2 to 3 feet wide) is welded together in a spiral. Most available pipe, however, is seamless and could not prevent expulsion of the plug in this manner.

U.S. Pat. No. 3,779,025 to Godley et al. discloses a method of installing a pile by driving a length of pipe into the ground, filling the pipe completely with concrete, curing the concrete and then driving the pipe further into the ground to a final bearing depth. However, since the pipe must be filled completely with concrete to enable completion of driving, much concrete and pipe are wasted whenever a substantial undriven portion of the pipe remains above ground and must be cut off when the pipe has been driven to final bearing depth.

SUMMARY OF THE INVENTION

The problems associated with known methods of driving thin-walled pipe pile are overcome in the present invention by providing a fast, effective method of driving thin-walled pipe. A closed-end thin-walled pipe is driven partially into the earth until firm bearing is reached. A significant portion, preferably a majority, of the partially driven pipe is then filled with a hardenable fluid concrete. After the concrete has hardened, a mandrel is inserted into the partially driven pipe to contact the upper extremity of the concrete, and the partially-driven pipe is driven downwardly to refusal bearing by driving the mandrel against the concrete. The excess pipe is cut off and concrete is then added to the completely driven pipe to complete the pile.

This method is fast because it enables the use of a long, top-driven, continuous pipe, for example, a 120-foot long pipe, and power hammer (air-diesel, etc.) for the initial driving to firm bearing, which is the majority of the driving. No sequentially-welded short pipe sections are needed to accommodate a mandrel during this initial driving step. Thereafter, even though the pipe is long, a mandrel of a practical length much shorter than that of the pipe can be used when driving from firm bearing to refusal bearing because the mandrel need merely be inserted to the upper extremity of the hardened concrete filling. Driving effectiveness is also enhanced when driving from firm bearing to refusal bearing because the partially filled portion of the pipe is relatively long and the hardened concrete is therefore firmly bonded to the pipe interior over a substantial length of the pipe. Finally, the lack of any need to fill the pipe completely with concrete to complete the driving avoids any waste of concrete or pipe.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figures 1, 2, 3, 4:
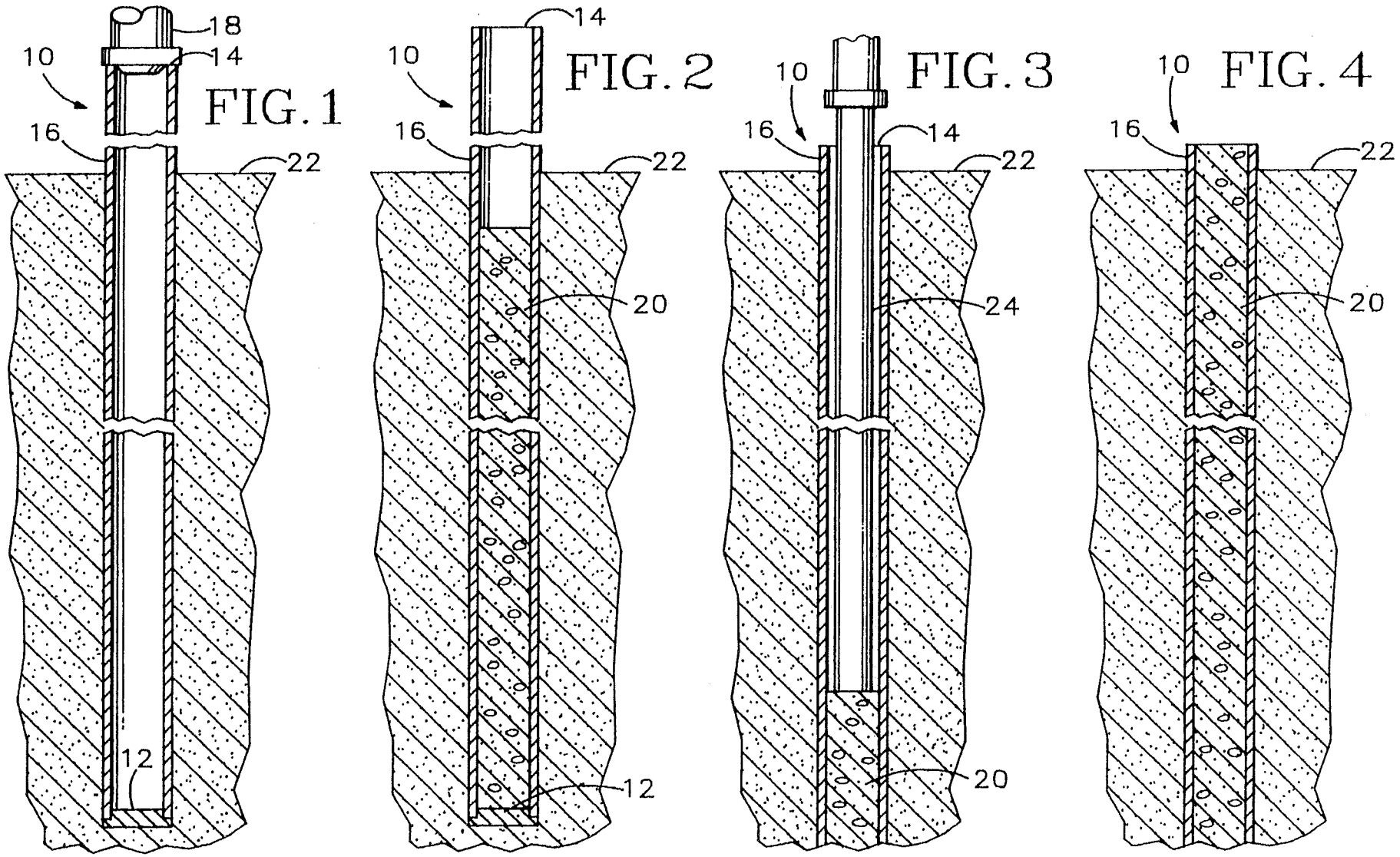
FIGS. 1–4 illustrate the sequential steps of the method of the present invention, with a thin-walled pipe shown in section and foreshortened.

Referring now to the drawings, a preferred embodiment 10 of the present invention, employs a thin-walled hollow steel pipe 16 having a closed end with a cap 12 and an open top 14. The pipe 16 is preferably a continuous, integral pipe for optimizing rapid driving, although the use of a pipe composed of sections sequentially welded end-to-end during the driving process is also intended to be within the scope of the present invention.

During initial driving, a pile driving hammer 18 drives against the open top 14 of the pipe, thus driving the closed end with the cap 12 into the earth, as shown in FIG. 1. The hammer 18 drives the pipe 10 until substantial resistance is met, that is, until firm bearing is reached. As shown in FIG. 2, the partially-driven pipe is then partially filled with a fluid concrete 20. Preferably the pipe is filled up to or near ground level 22. The concrete is permitted to cure and harden until it has attained a substantial portion of its strength; a period of 1–2 days is usually sufficient.

As shown in FIG. 3, after the concrete has attained an adequate hardness, a mandrel 24 is inserted through the open end 14 of the pipe 10 to contact or bear against the upper extremity of the cured concrete 20. The mandrel is made from a strong relatively hard material such as API-N80 steel. The partially-filled pipe is then driven downwardly further into the earth by driving with the mandrel on the cured concrete until driving is complete. When driving is complete, any excess portion of the pipe is cut off at grade and the remainder is filled with concrete as shown in FIG. 4. The further concrete is permitted to cure and the pile is completed. The excess portion of the pipe which has been cut off is used to make up pipe for further piles.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for forming a load-carrying pile using thin-walled pipe, comprising:

(a) driving a closed-end hollow pipe partially into the earth until firm bearing is reached;

(b) thereafter partially but not completely filling the interior of said pipe with hardenable fluid concrete and hardening said concrete;

(c) thereafter inserting a mandrel into said pipe and driving said mandrel to apply force against the upper extremity of said concrete to drive said pipe further into the earth; and (d) thereafter adding further hardenable fluid concrete to the interior of said pipe atop the concrete hardened in step (b), and permitting said further concrete to harden.

2. The method of claim 1 wherein step (a) comprises exerting driving force against the top of said pipe.

3. The method of claim 1 including the step of removing from said pipe a portion thereof remaining above ground and unfilled with said concrete.

4. The method of claim 1 wherein step (b) comprises filling at least a majority of said pipe with said concrete.

5. The method of claim 1 including avoiding, after step (a) commences, adding to said pipe any extension thereof which is driven into the earth by said mandrel in step (c).

6. A method for forming a load-carrying pile using thin-walled pipe, comprising:

(a) driving a closed-end hollow pipe partially into the earth until at least a majority thereof has been driven into the earth;

(b) thereafter filling a majority, but less than all, of said pipe with hardenable fluid concrete and hardening said concrete;

(c) thereafter inserting a mandrel into said pipe and driving said mandrel to apply force against the upper extremity of said concrete to drive said pipe further into the earth;

(d) thereafter adding further hardenable fluid concrete to the interior of said pipe atop the concrete hardened in step (b), and permitting said further concrete to harden; and (e) avoiding, after step (a) commences, adding to said pipe any extension thereof which is driven into the earth by said mandrel in step (c).

* * * * *